US005575617A

United States Patent [19]

Marmilic et al.

[11] Patent Number: 5,575,617

[45] Date of Patent: Nov. 19, 1996

[54] APPARATUS FOR COOLING AN AXIAL-FLOW GAS TURBINE

[75] Inventors: Robert Marmilic, Baden; René Wälchli, Niedergösgen, both of Switzerland

[73] Assignee: ABB Management AG, Baden, Switzerland

[21] Appl. No.: 510,504

[22] Filed: Aug. 2, 1995

[30] Foreign Application Priority Data

Sep. 19, 1994 [DE] Germany ..... 44 33 289.0

[51] Int. Cl.[6] ..... F01D 5/08; F01D 25/12

[52] U.S. Cl. ..... 415/115; 415/176; 415/230

[58] Field of Search ..... 415/115, 175, 415/176, 230

[56] References Cited

U.S. PATENT DOCUMENTS

| | | | |
|---|---|---|---|
| 3,826,084 | 7/1974 | Branstrom et al. | 415/115 |
| 4,296,599 | 10/1981 | Adamson | 415/115 |
| 4,574,584 | 3/1986 | Hovan | 415/175 |
| 4,645,415 | 2/1987 | Hovan et al. | 415/115 |
| 4,961,309 | 10/1990 | Liebl | 415/115 |
| 5,327,719 | 7/1994 | Mazeaud et al. | 415/115 |

FOREIGN PATENT DOCUMENTS

| | | | |
|---|---|---|---|
| 974790 | 4/1961 | Germany . | |
| 1476766 | 6/1969 | Germany . | |
| 2119024 | 11/1971 | Germany . | |
| 4225625A1 | 2/1994 | Germany . | |
| 2189845 | 11/1987 | United Kingdom . | |
| 0447886 | 3/1991 | WIPO | 415/115 |

*Primary Examiner*—Edward K. Look
*Assistant Examiner*—Michael S. Lee
*Attorney, Agent, or Firm*—Burns, Doane, Swecker & Mathis

[57] ABSTRACT

An apparatus for cooling an axial-flow gas turbine of the type comprising a multi-stage turbine (1) which drives a compressor (10) arranged on a common shaft (13), involves means for removing leakage air from the space surrounding the portion of the shaft between the turbine and the compressor. In such an installation, the portion of the shaft between the turbine (1) and the compressor (10) is shaped as a drum (14) and is surrounded by a drum cover (15), which forms an annular duct (20). A labyrinth seal (21) sealing against the drum cover (15) is disposed in the annular duct (20), and the drum cover (15) together with the end face (18) of the turbine rotor (3) defines a radially directed wheel side space (19). Separate lines (22) for carrying the turbine-rotor cooling air from the compressor (10) to the end face (18) of the turbine rotor (3) are provided, and the connection between these lines (22) and the wheel side space (19) is made via at least one swirl nozzle (23). Cooling devices (24) are provided for introducing cooling air to the turbine rotor (3) and its moving-blade rings, and all the cooling air for the rotor side for the turbine (1) is extracted from the compressor (10) in the area of the compressor discharge. At least one suction device (25) for removing the leakage air and a portion of the cooling air from the annular duct is connected to the annular duct in the area of the drum labyrinth (21). The suction device (25) is connected to deliver the removed leakage air to cooling devices for the rear turbine stages.

5 Claims, 4 Drawing Sheets

APPARATUS FOR COOLING AN AXIAL-FLOW GAS TURBINE

FIELD OF THE INVENTION

The invention relates to an axial-flow gas turbine essentially consisting of a multi-stage turbine which drives a compressor arranged on a common shaft, the part of the shaft lying between turbine and compressor being formed as a drum.

Gas turbines of this type are known. All the cooling air on the rotor side is extracted, for example, from the compressor end. The predominant portion of the cooling air flows through separate lines and via a swirl cascade into turbine cooling ducts. As disclosed by GB 2 189 845, the swirl nozzle as a rule is located on the same radius as the rotor cooling ducts at the end face of the turbine rotor. The smaller portion of cooling air serves to cool the last compressor disk, the drum and the first turbine disk.

In EP 0 447 886, all the cooling air required for the rotor cooling is extracted after the last moving row of the compressor at its hub and is directed with the swirl inherent in it directly into the annular duct located between the rotor drum and the drum cover. The cooling air flows up to the drum labyrinth. The unavoidable leakage quantity flows through the labyrinth, while the main portion of the rotor-cooling air is directed into a swirl cascade. The cooling air is accelerated in the swirl cascade while being deflected at the same time in the direction of rotation of the rotor. In the process, the outflow from the swirl cascade takes place virtually tangentially. The leakage mass flow through the drum labyrinth under the swirl cascade mixes with the cooling air after the swirl cascade in the area of the turbine disk.

A problem occurs, however, in gas turbines having a high pressure ratio. Since the air after the last moving row of the compressor is too hot for cooling the turbine blades, this air must first be recooled before it passes through the swirl cascade into the cooling air ducts of the turbine rotor. The large temperature difference between the cooling air and the labyrinth leakage air along the rotor drum leads to high stresses in the rotor drum and turbine disk area. In addition, the mixing of the cold cooling air with the hot leakage air after the swirl cascade leads to undesirable heating-up of the cooling air and to weakening of the swirl.

In order to obtain the requisite pressure in the rotor cooling air system, a labyrinth seal is normally necessary between the turbine-rotor disk and the disk cover above the swirl cascade. Consequently, in the event of damage to the drum labyrinth, the pressure along the turbine disk increases and leads to a massive increase in the axial thrust of the rotor.

SUMMARY OF THE INVENTION

Accordingly, in an axial-flow gas turbine of the type mentioned at the beginning, one object of the invention, in attempting to avoid all these disadvantages, is to reduce the axial thrust, improve the effectiveness of the blade and disk cooling, and achieve a uniform temperature distribution.

According to the invention, this is achieved in an axial-flow gas turbine when at least one suction device for removing the leakage air and a portion of the cooling air is arranged in the area of the drum labyrinth.

The advantages of the invention can be seen, inter alia, in the fact that the turbine disk and part of the rotor drum are only swept by the cooling air. This results in a lower and, in particular, a more uniform temperature distribution, which has a positive effect on the strength at the rotor/disk transition. Since mixing with the cooling air is also avoided by removal of the leakage air, the cooling air is not heated and the swirl of the cooling air remains undisturbed.

It is advantageous when the annular duct is widened in the area of the suction device to form a collecting space for the leakage or cooling air, since improved removal is thereby guaranteed.

Furthermore, it is expedient when the suction device consists of a line which is connected on the one side to the collecting space for the leakage or cooling air and on the other side to the annular cooling air extraction space in the compressor casing.

Furthermore, the suction device is advantageously connected to the cooling air devices for the rear turbine stages, since the removed leakage air is thereby added to the cooling air for the rear turbine stages and thus continues to be used in a useful manner for the process.

It is expedient when at least one feed to the annular duct is arranged in the compressor-side part of the rotor drum for feeding a portion of the cooling air to the annular duct, which feed has at least one swirl nozzle at its respective end. Cooling air can thereby likewise be added to the hot leakage air so that the air temperature is lowered to the admissible value in this area.

Finally, the pressure of the cooling air after the swirl nozzle is advantageously selected in such a way that the normally conventional labyrinth seal between turbine disk and disk cover can be dispensed with so that the pressure near the turbine disk is determined by the pressure of the turbine main flow in the gas duct. In the event of damage to the rotor-drum labyrinth, a large pressure increase at the turbine disk is prevented by the omission of the disk labyrinth and by the removal of the increased leakage air so that the axial thrust of the rotor changes only slightly. The drum and disk temperatures also remain relatively stable in the event of an increase in the labyrinth play.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Only the elements essential for understanding the invention are shown. Elements of the plant which are not shown are, for example, the exhaust-gas casing of the gas turbine with exhaust-gas pipe and flue as well as the inlet portions of the compressor part. The direction of flow of the working media is designated by arrows.

DETAILED DESCRIPTION

Figure 1A:
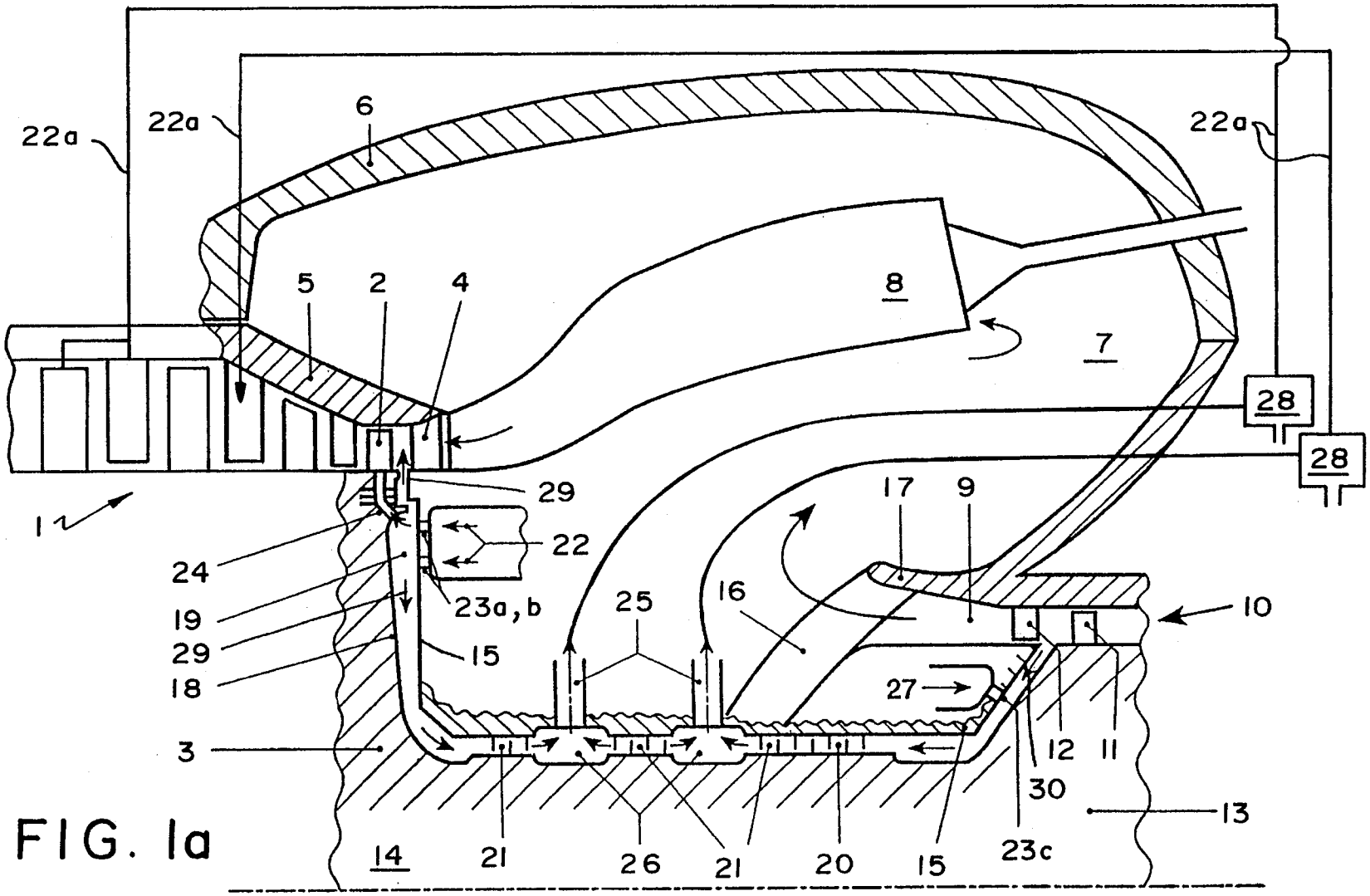
FIG. 1*a* shows a partial longitudinal section of the gas turbine illustrating the cooling apparatus in accordance with the invention.
Figure 1B:
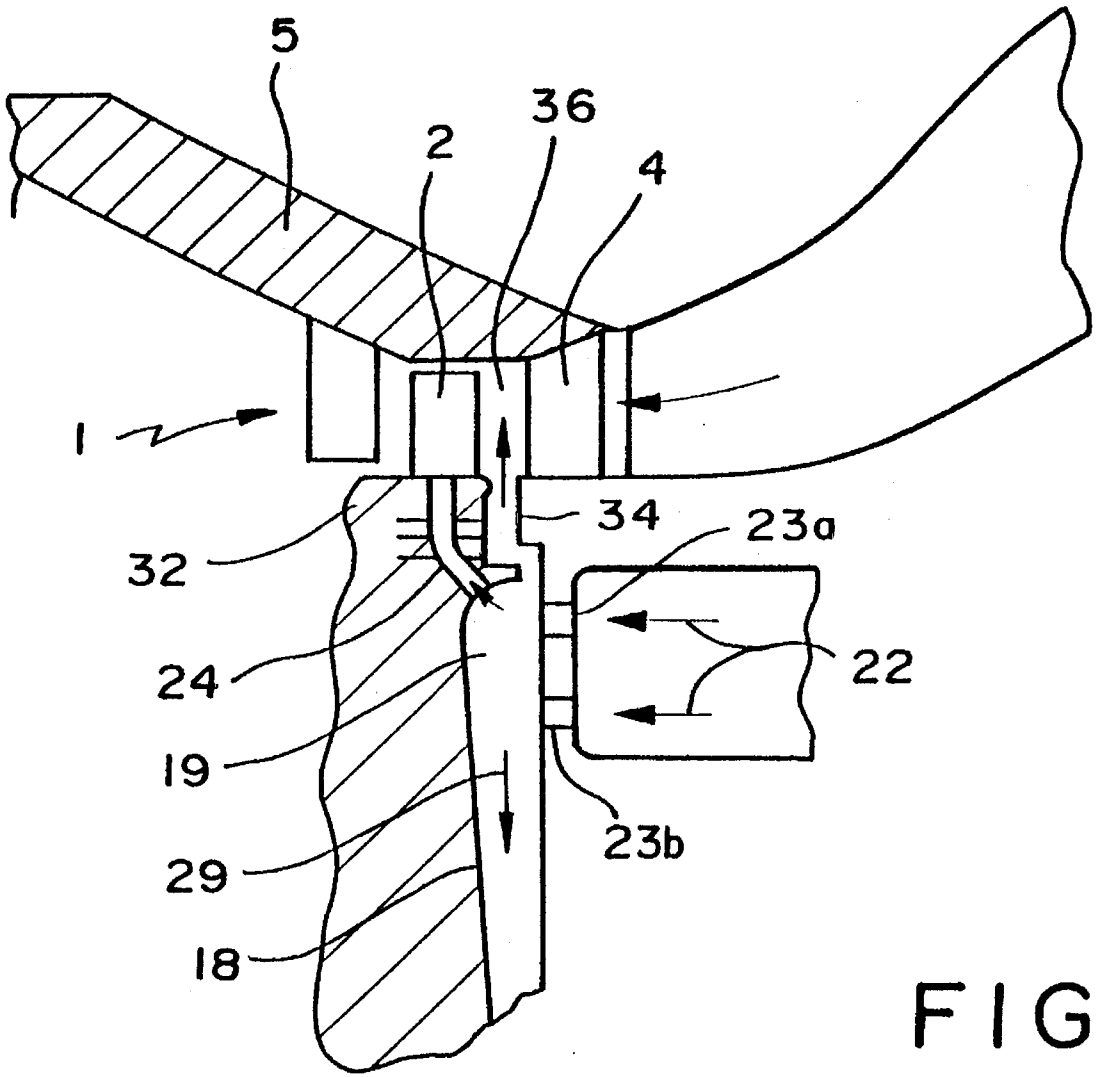
FIG. 1*b* is an enlargement of an inlet of the turbine of FIG. 1*a;*

Referring now to the drawings, wherein like reference numerals designate identical or corresponding parts throughout the several views, it can be gathered from FIG. 1*a* that the axial-flow turbine 1 comprises the rotor 3 fitted with moving blades 2 and the blade carrier 5 fitted with guide blades 4. The blade carrier 5 is hung in the turbine casing 6. The turbine casing 6 also contains the collecting space 7 for the compressed combustion air.

The combustion air passes from the collecting space 7 into the annular combustion chamber 8, which leads into the turbine inlet. The compressed air flows into the collecting space 7 from the diffuser 9 of the compressor 10. Of the compressor 10, only the last stage having the moving blades 11 and the guide blades 12 is shown in FIG. 1*a*. The moving blading of the compressor 10 and the turbine 1 sits on a common shaft 13. The portion of the shaft 13 located between turbine 1 and compressor 10 is designed as a drum 14.

The drum 14 is surrounded by a drum cover 15 (shown in partial view) which is connected to the outer casing 17 of the diffuser via ribs 16. On the turbine side, the drum cover 15 together with the end face 18 of the turbine rotor 3 defines a radially running wheel side space 19.

The wheel side space 19 forms the end of an annular duct 20 forming a space between the drum 14 and the drum cover 15. A labyrinth seal 21 sealing against the drum cover 15 is arranged in this annular duct 20.

A line 22 from the compressor outlet end for carrying cooling air for the turbine rotor 3 leads into the wheel side space 19. Swirl nozzles 23*a, b* are arranged at the end of the line 22. Here, the swirl nozzle 23*a* for the main portion of cooling air for the turbine rotor 3 is preferably arranged on the same radius as the rotor cooling ducts 24 or the inlet opening of the rotor cooling ducts 24, while one or more further swirl nozzles 23*b* are arranged at a smaller radial distance from the main turbine axis and serve to add cooling air 29 for the end face 18 of the turbine rotor 3.

In this exemplary embodiment, two suction devices 25 for removing the leakage air 30 and a portion of the cooling air from the annular duct 20 are arranged in the area of the drum labyrinth 21.

Figure 2:
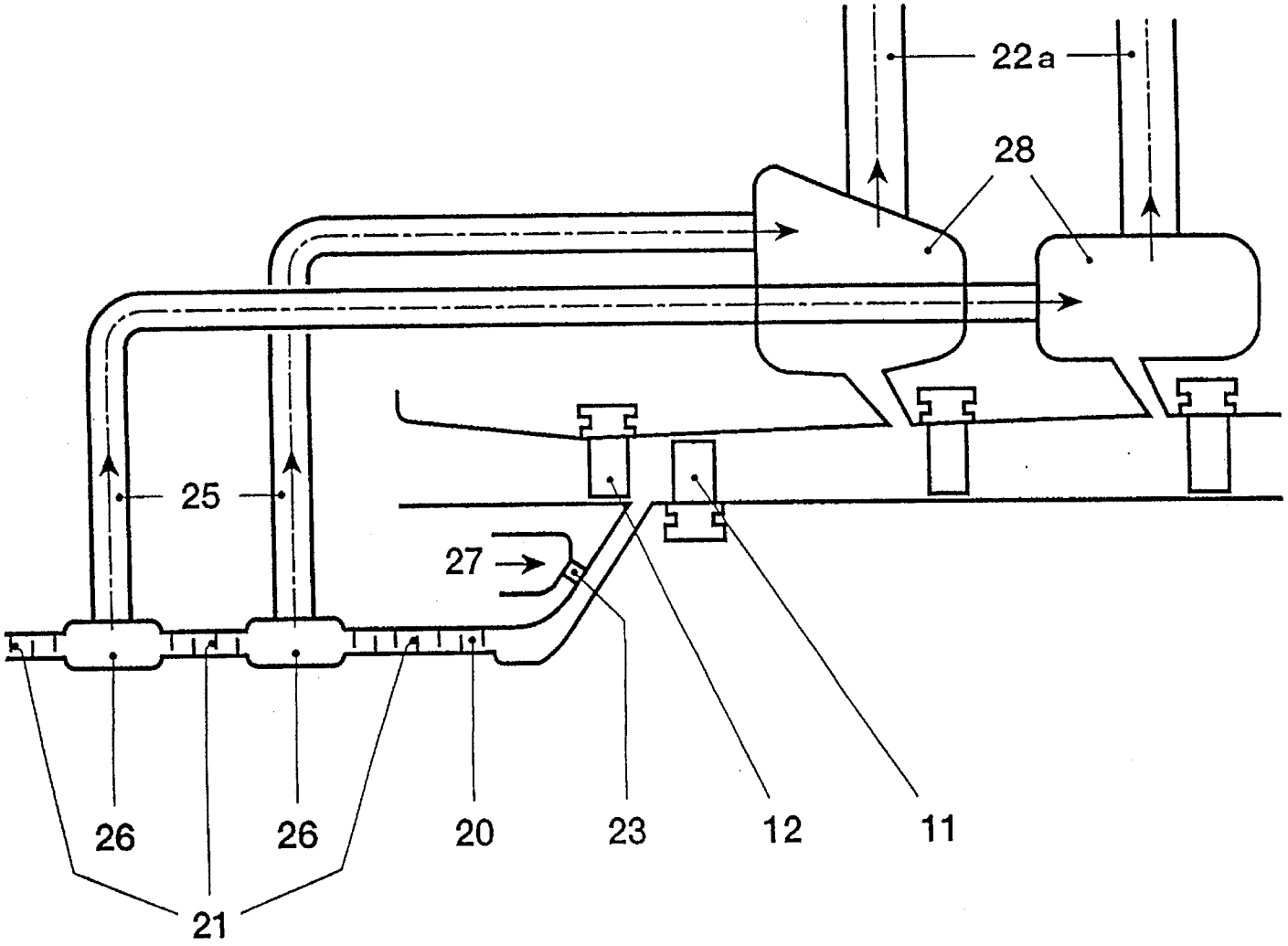
FIG. 2 shows an enlarged partial longitudinal section in the area of the drum labyrinth and the suction device.

FIG. 2 shows in detail a possible embodiment variant of the suction device 25. The annular duct 20 is widened in the area of the suction devices 25 to form two collecting spaces 26. Here, the two suction devices 25 are lines which are connected on the one side to the collecting spaces 26 for the leakage air and on the other side to the annular cooling air extraction spaces 28 in the compressor casing. Lines 22*a* lead from the annular extraction spaces 28 to the cooling system of the rear turbine stages. The arrangement of the collecting spaces 26 in the drum labyrinth 21 is here selected so that the resulting pressure drop between the collecting spaces 26 and spaces 28 and the cross sections of the lines 25 produce the removal the hot leakage air 30 and mixed in cooling air from the annular duct 20. The invention is of course not restricted to this embodiment variant; the suction device 25 can also be of different design.

Furthermore, a feed 27 to the annular duct 20 can also be additionally arranged in the compressor side part of the rotor drum 14 for a small portion of the cooling air, which feed 27 likewise has at least one swirl nozzle 23*c* at its end facing the annular duct 20. The swirl nozzles 23 are acceleration cascades having a small curvature of the median line. The admixing of cooling air to the hot mass flow of leakage air 30 leads to an air mixture having a temperature at an admissible value for the compressor side of the rotor drum 14.

Figure 3A:
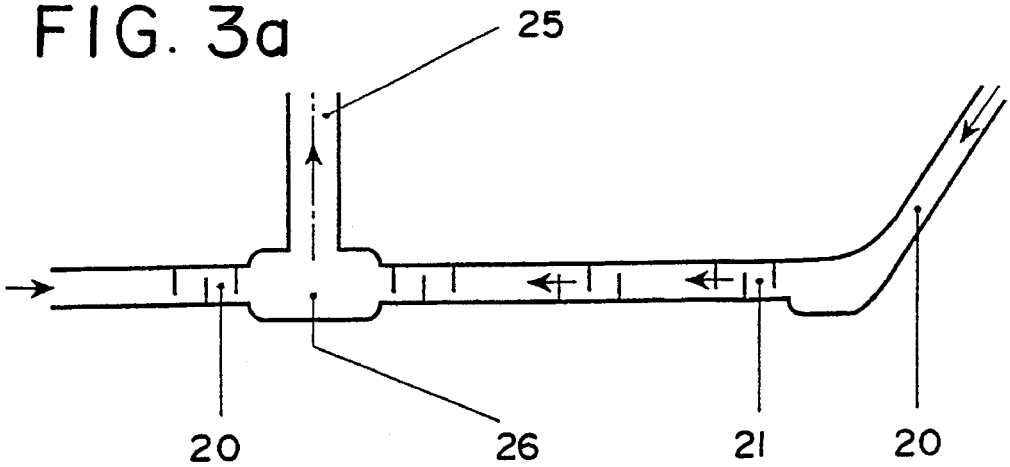
FIGS. 3*a*–3*c* show three different possibilities for the arrangement of the suction device.
Figure 3B:
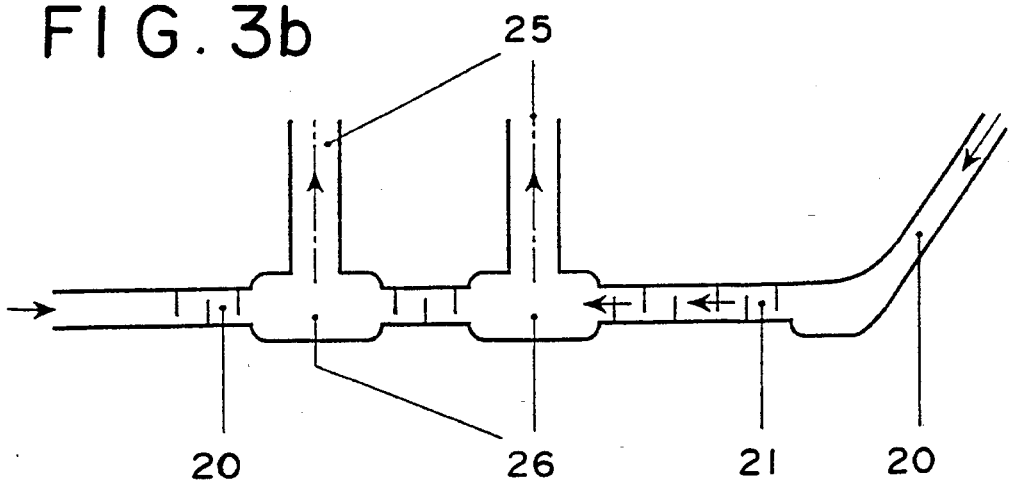
Figure 3C:
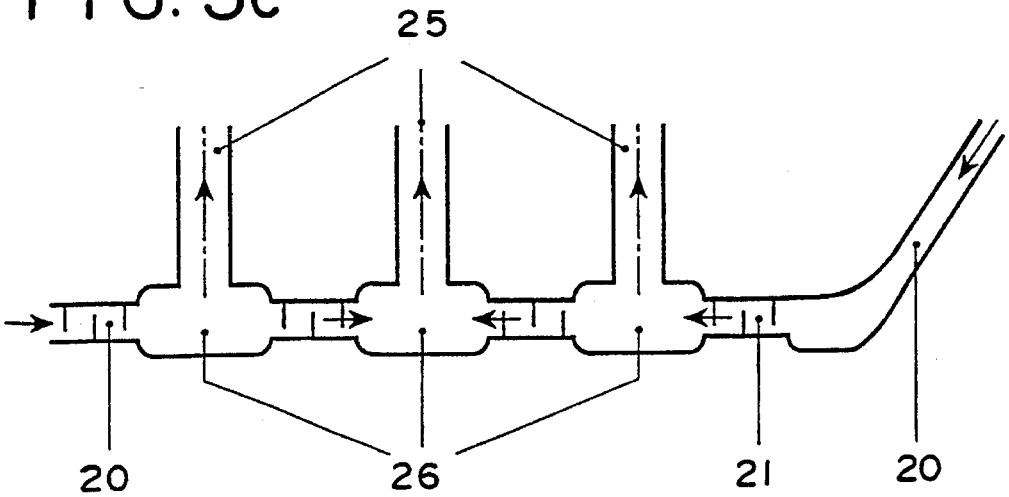

FIG. 3 shows that only one suction device 25 or more than two suction devices 25 for the leakage or cooling air can also be arranged.

The mode of operation of the invention is explained below: cooling air required for the rotor cooling is extracted at the compressor outlet end. The main portion of the rotor cooling air flows via the line 22 and the swirl nozzle 23*a, b* into the wheel side space 19. The largest portion of this swirled cooling air flows into the cooling ducts 24 of the rotor 3 via the inlet openings located at the same height as the swirl nozzle 23*a*, while a small portion flows between turbine disk 32 and disk cover 34 into the gas duct 36 of the turbine 1. Further cooling air is passed into the wheel side space 19 through a further swirl nozzle 23*b* which is arranged at a smaller radial distance from the main turbine axis than the aforesaid swirl nozzle 23*a*. This cooling air 29 flows in the direction of the annular duct 20 and, together with the mass leakage air flow 30 coming from the other direction from the compressor 10 and extracted from the compressor after the last moving blade 11, is drawn off into the suction devices 25 arranged in the area of the drum labyrinth 21. The mass leakage air flow can of course also be extracted from the compressor at another point, for example after the last guide blade 12 of the compressor 10. The air removed by the suction devices 25, on account of its low pressure, is then added, for example, to the cooling air extracted into the extraction spaces 28 for the rear turbine stages and thus continues to be used in a useful manner for the process.

Owing to the fact that the mass leakage air flow and a small portion of the cooling air added through one or more swirl nozzles 23*b, c* is drawn off at the drum labyrinth 21, the turbine disk 32 and part of the rotor drum 14 are only swept by the cooling air. This has the advantage of a more uniform and lower temperature distribution, which has a favorable effect on the rotor disk area.

With the drawing off of the leakage air by the suction devices in the annular duct 20, the mixing of leakage air with the cooling air from the swirl nozzle 23*a* is also avoided. The swirl of the cooling air after the swirl nozzle 23*a* is no longer affected by the leakage air, nor is the cooling air heated by the hotter leakage air; consequently the inlet conditions in the rotor cooling system are virtually constant, the capacity of the cooling air is better, and the inlet losses in the rotor cooling system are minimized.

The cooling air pressure after the swirl nozzle 23 can now be selected in such a way that the labyrinth seal normally arranged between turbine disk and disk cover can be dispensed with. The pressure near the disk 32 is thereby determined by the pressure of the main turbine flow in the gas duct 36.

In the event of damage to the rotor drum labyrinth 21, a large pressure increase at the turbine disk is prevented by the omission of a disk labyrinth and by the increased leakage air quantity so that the axial thrust of the rotor changes only slightly. The drum and disk temperatures remain relatively stable in the event of an increase in the labyrinth play.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for cooling an axial-flow gas turbine, comprising:

a multi-stage turbine and a compressor connected on a common shaft, the turbine having a rotor, wherein a portion of the shaft between the turbine and the compressor is formed as a drum, a drum cover surrounding the drum shaped portion of the shaft and spaced therefrom to define an annular duct connected to the compressor to carry leakage air from the compressor, a labyrinth seal mounted on the drum cover and disposed in the annular duct for sealing the drum shaped portion of the shaft against the drum cover, wherein an end face of the drum cover and an adjacent end face of the turbine rotor define therebetween a radially directed wheel side space connected to the annular duct, at least one separate line for carrying cooling air from the compressor to the end face of the turbine rotor, at least two swirl nozzles disposed in the at least one separate line to introduce air from the line into the wheel side space, cooling devices for introducing cooling air from the wheel side space to the turbine rotor and moving-blade rings on the rotor, and at least one suction device connected to the annular duct in an area of the labyrinth seal for removing the leakage air from the annular duct.

2. The apparatus as claimed in claim 1, wherein the annular duct is shaped to form a widened collecting space for collecting leakage air, the at least one suction device being connected to the collecting space.

3. The apparatus as claimed in claim 2, wherein the at least one suction device consists of a duct connected on one end to the collecting space and on an other end to an annular extraction space in a compressor casing for extracting cooling air from the compressor.

4. The apparatus as claimed in claim 1, wherein the suction device is connected to deliver leakage air removed from the annular duct to devices for delivering cooling air to rear stages of the turbine.

5. The apparatus as claimed in claim 1, comprising means for introducing cooling air to the annular duct at a compressor side of the rotor drum, said means including at least one swirl nozzle disposed to guide cooling air into the annular duct.

* * * * *